United States Patent [19]

Ongaro

[11] 4,222,309

[45] Sep. 16, 1980

[54] HYDRAULIC POWER SYSTEM

[76] Inventor: Theodore Ongaro, c/o Ongaro Dynamics, Ltd., 939 King Ave., Columbus, Ohio 43212

[21] Appl. No.: 874,371

[22] Filed: Feb. 2, 1978

Related U.S. Application Data

[62] Division of Ser. No. 750,562, Sep. 7, 1976, Pat. No. 4,096,784.

[51] Int. Cl.[2] ..... F01B 25/02

[52] U.S. Cl. ..... 91/471; 91/165; 91/465

[58] Field of Search ..... 91/51, 165, 454, 465, 91/417, 510, 533, 166, 464, 443, 449, 463, 415, 471; 60/327, 368

[56] References Cited

U.S. PATENT DOCUMENTS

| | | | |
|---|---|---|---|
| 1,353,656 | 9/1920 | Heisler | 91/533 |
| 2,672,731 | 3/1954 | Ashton | 91/454 |
| 2,954,794 | 10/1960 | Paine | 91/465 |
| 3,200,713 | 8/1965 | Viersma | 91/51 |
| 3,260,164 | 7/1966 | Guentner | 91/465 |
| 3,370,513 | 2/1968 | Shore | 91/51 |
| 3,444,784 | 5/1969 | Wengerd | 91/533 |
| 3,608,431 | 9/1971 | Pease | 91/454 |
| 3,645,167 | 2/1972 | Espenschied | 91/51 |
| 3,834,276 | 9/1974 | Gournelle | 91/51 |
| 4,003,547 | 1/1977 | Snyder | 91/471 |
| 4,011,795 | 3/1977 | Barthe | 91/165 |

*Primary Examiner*—Abraham Hershkovitz
*Attorney, Agent, or Firm*—Frost & Jacobs

[57] ABSTRACT

A method of operating an hydraulic power system having a piston with opposing piston heads reciprocally mounted in opposing piston chambers, the piston being directionally responsive to a pair of control valves adapted to be sequentially opened and closed to actuate the piston for movement in opposite directions. The control valves each having a series of sequentially acting valve elements which control fluid flow to and from the piston, a condition being established in which the piston is at one end of its stroke and a first of the piston heads is under relatively high pressure and the other under relatively nominal pressure, the piston being driven to the opposite end of its stroke by first relieving the high pressure on the first of the piston heads to a nominal level and thereafter rapidly increasing the fluid pressure on the other of the piston heads, the piston and control valves working at all times against solid columns of fluid under controlled positive pressures.

7 Claims, 7 Drawing Figures

HYDRAULIC POWER SYSTEM

This is a division of application Ser. No. 750,562, filed Sept. 7, 1976, now U.S. Pat. No. 4,096,784.

BACKGROUND OF THE INVENTION

The present invention relates to hydraulic power systems and has to do with the operation of a system operable in cyclic order at a rate of over 500 Hz associated with mass movements involving force of as much as 500 G's.

In the current state of the art in the hydraulic power field there are numerous systems ranging from a simple cylinder and piston powered by a hydraulic pump controlled by a simple two-way hand operated valve to highly complex and intricate systems, including numerous kinds and types of servo valves. These systems are electronically, hydraulically or mechanically controlled in a multitude of combinations capable of generating forces of almsot any desired magnitude. Fluid velocities of well over 500 feet per miunte with volumes up to several hundred gallons per minute and pressures in the tens of thousands of pounds per square inch are not uncommon. Even though a multitude of systems are available in the hydraulic field, none is operable in the cyclic order at the rate of over 500 Hz associated with large mass movements involving acceleration at the rate of several hundred or more G's, a G being the unit of force applied to a body at rest equal to the force exerted on it by gravity, the standard or accepted value being 980.665 cm/sec.$^2$.

The present invention relates to a new generation of hydraulic power systems operable from the initial command to the conclusion of the power stroke with a phase lag of less than 10° with force capabilities limited only by the strength of the components making up the system.

RESUME OF THE INVENTION

In accordance with the present invention, the power system comprises a housing containing a dual acting piston having an opposing pair of heads each movable within its own piston chamber, each of the piston chambers being connected on its inlet side through passageways to a source of high pressure fluid, the opposite side of each piston chamber being connected through additional passageways to a discharge outlet which returns discharged fluid to a source of supply. Movement of the piston is controlled by a pair of control valves adapted to be sequentially opened and closed, the control valves being of identical construction and having a series of sequentially acting valve elements which control fluid flow through the passageways and the piston chambers. The control valves are so arranged that they have high and low pressure sides and will alternately supply fluid under high pressure to displace the opposing piston heads, the control valves additionally serving to control the discharge of the fluid from the opposite side of the system in such a way that the entire system remains fully charged with fluid at all times, the piston heads and control valves always working against solid columns of fluid under controlled positive pressures.

The control valves are composed of a series of poppet valve elements which, for maximum efficiency, are light in weight and require a minimum amount of travel. Each of the control valves has a pair of valve elements which control the introduction of high pressure fluid into one of the piston chambers, together with another pair of valve elements which control the discharge of fluid from the other of the piston chambers, the system also incorporating sets of check valves in both the inlet and outlet passageways which coact to control the flow of fluid so that the system remains completely filled with fluid, although the fluid is at different pressures in different parts of the system depending upon the particular stage of operation.

A positive but nominal fluid pressure, such as 20–80 psi, is maintained in the system at all times with charges of fluid under high pressure alternatively introduced into the opposite sides of the system to alternately displace the opposing piston heads, the high pressure charges being maintained in the system until relieved upon commencement of the opening movement of the other of the control valves, the arrangement being such that the high pressure fluid on one side of the system will be relieved prior to the introduction of high pressure fluid on the other side of the system. The only limit on the magnitude of the high pressure fluid is the strength of the materials making up the system, and pressures in the tens of thousands of pounds may be employed,.

The dual acting piston in conjunction with the control valves and their passageways form an hydraulic closed loop which is pressurized at all times, even when in an idle state. Since the system is completely filled with fluid at all times, and since the hydraulic fluid is essentially incompressible, the piston will be fixedly maintained at either end of its stroke by the full force of the high pressure fluid which drove the piston from one end of its stroke to the other, the high pressure fluid being retained in the system until relieved upon the opening of the control valve which initiates movement of the piston in the opposite direction.

The closed loop system is effectively leak free in that the piston rods, which are the source of most leakage problems, project outwardly from the outer ends of the piston heads, whereas the hydraulic fluid contacts only the inner ends of the piston heads. Consequently, the piston rods are at no time in contact with the hydraulic fluid and hence may be packless. The elimination of the necessity for packings is another factor contributing to the versitility of the system and its capability to generate accelerating forces of high magnitude.

In accordance with the invention, the control valves may be mechanically actuated, as by means of actuating cams, or they may be actuated electrically, as by means of solenoids, although preferably the control valves will be actuated hydraulically by means of hydraulic actuating valves which, like the power system itself, form a closed loop system working at all times against solid columns of fluid, thereby avoiding the time lag inherent in systems wherein the fluid conduits must be filled and drained. Where electrical or hydraulic actuating means are employed, they may be remotely controlled as opposed to the direct mechanical contact between the control valves and the actuating cams.

DESCRIPTION OF THE PREFERRED EMBODIMENTS

Figure 1:
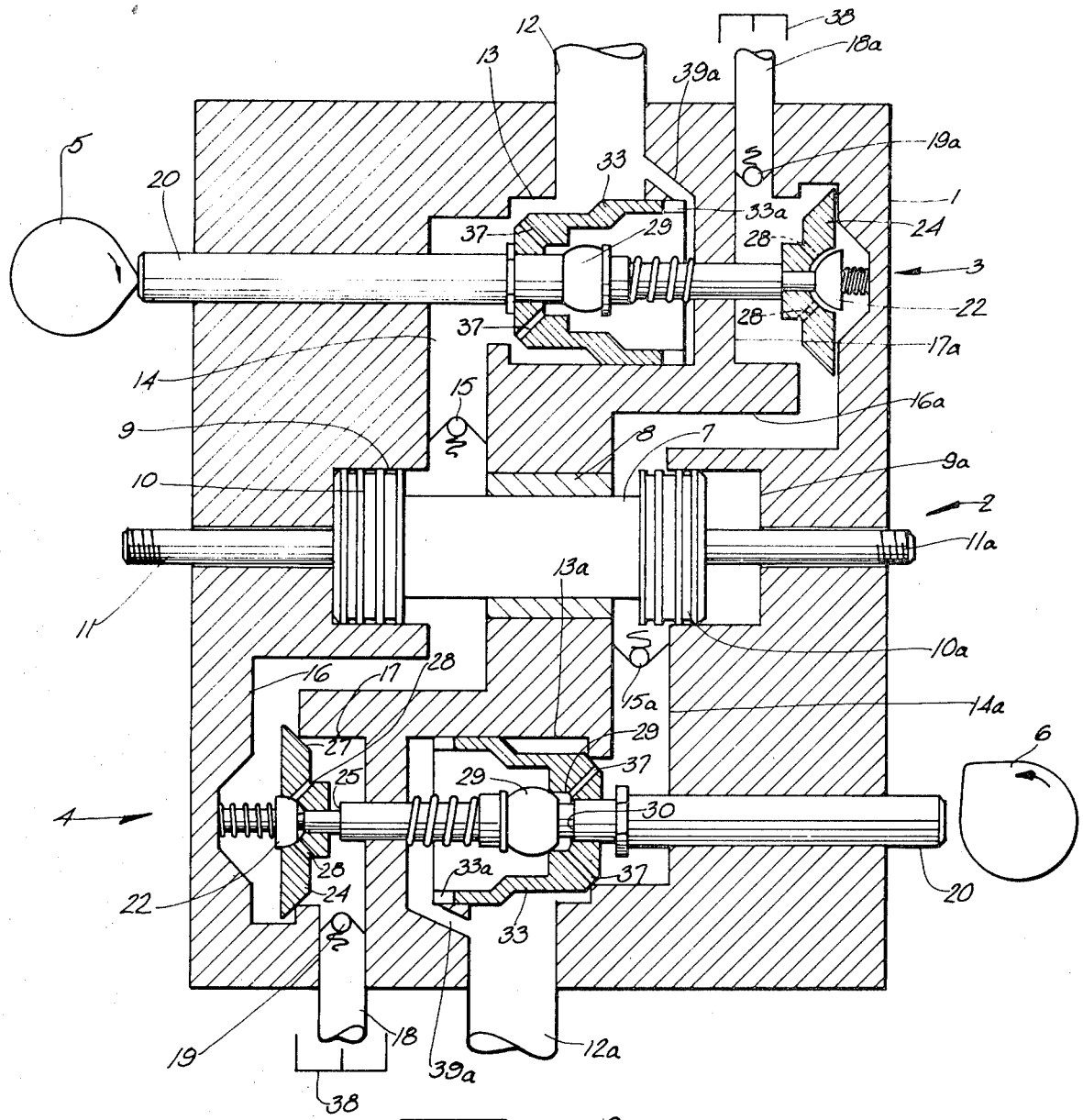
FIG. 1 is a sectional view of an hydraulic control system in accordance with the invention in which one of the control valves is in the fully closed position and the other is in the fully open position, the control valves being actuated by a pair of timing cams.

Referring first to FIG. 1 which illustrates the basic components of the system, the housing 1 is provided with a centrally disposed dual acting piston, indicated generally at 2, and a pair of control valves indicated generally at 3 and 4, mounted within the housing on opposite sides of the piston 2. In the embodiment illustrated, the control valves 3 and 4 are adapted to be directly actuated by the cam members 5 and 6, respectively, although as will be pointed out in greater detail hereinafter, other forms of actuating means may be provided to operate the control valves. At the outset, it is to be understood that for simplicity of illustration conventional gaskets, seals and the like for the piston and control valves and other moving parts have been omitted.

The dual acting piston 2 has a cylindrical body 7 slidably journaled in the centrally disposed bearing 8 which forms a seal between the opposing piston chambers 9 and 9*a*, the chambers being of identical configuration and slidably receiving the identical opposing piston heads 10 and 10*a* mounted on the opposite ends of the cylindrical piston body 7. Piston rods 11 and 11*a* project outwardly through the housing from the outermost ends of the piston heads 10 and 10*a*, respectively, although it will be understood that either of the piston rods may be omitted depending upon the nature and location of the external means which will be driven by the piston. With this arrangement, the piston rods are isolated by the piston heads from the fluid which actuates the piston heads and the necessity for having high pressure packings or other seals for the piston rods is eliminated, thereby eliminating a troublesome source of fluid leakage.

Fluid under high pressure is delivered to piston chamber 9 through inlet passageway 12, valve chamber 13 and delivery passageway 14 which communicates with piston chamber 9 to the inside of piston head 10. A check valve 15 in passageway 14 is oriented to permit fluid to flow through passageway 14 into chamber 9, but fluid in chamber 9 cannot flow back into passageway 14. The piston chamber 9 also communicates with a discharge passageway 16 which, in turn, communicates with an outlet valve chamber 17, the oulet chamber being in communication with an outlet passageway 18 having a check valve 19 oriented to permit fluid to flow outwardly through the outlet passageway but not inwardly. In like manner, the piston chamber 9*a* is supplied with fluid under high pressure through inlet passageway 12*a*, inlet valve chamber 13*a*, and delivery passageway 14*a* which contains a check valve 15*a*. Fluid is discharged from piston chamber 9*a* through discharge passageway 16*a*, outlet valve chamber 17*a*, and outlet passageway 18*a* having a check valve 19*a*. It will be understood that inlet passageways 12 and 12*a* will be connected to a source of fluid under high pressure, and the outlet passageways 18 and 18*a* will be connected to conduits which return discharged fluid to the source of fluid supply.

The control valves 3 and 4 are of identical construction, each having an elongated axial movable valve stem 20 one end of which projects outwardly from the housing 1 where its free end is positioned to be contacted by one of the cams 5 or 6, the cam 5 serving to displace the valve stem of control valve 3 and the cam 6 serving to displace the valve stem of control valve 4. The cams will be driven in timed relation in accordance with the desired operating sequence of the control valves, with each control valve opened and closed during each cycle of rotation of the cams. Each valve stem mounts a series of four valve elements, two of which are associated with the inlet valve chamber 13 or 13*a* and form the high pressure side of each control valve, the remaining two valve elements being associated with the outlet valve chambers 17 or 17*a* to form the low pressure side of each control valve, although as will become apparent hereinafter the valve elements on the low pressure sides work against high pressure fluid during a portion of their operating cycle.

Figure 2:
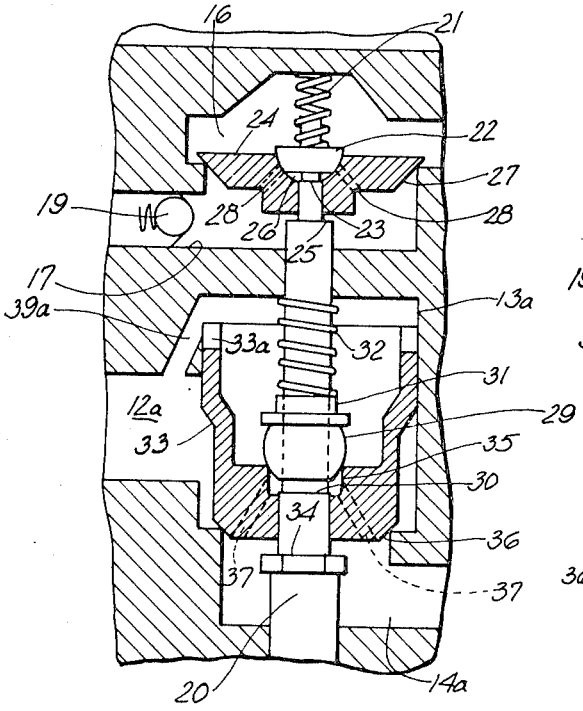
FIG. 2 is an enlarged sectional view of one of the control valves in the fully closed position.
Figure 3:
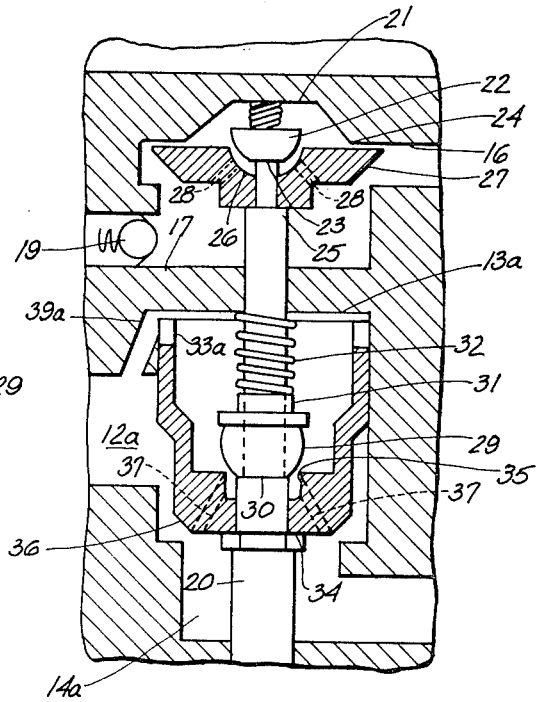
FIG. 3 is a sectional view similar to FIG. 2 illustrating the control valve in the fully open position.

For a better understanding of the construction of the control valves, reference is made to FIGS. 2 and 3 which are enlarged views of control valve 4 in the closed and opened positions, respectively. A spring 21 surrounds the distal end of the valve stem 20 and extends between an offset in discharge passageway 16 and a first valve element 22 slidably mounted on the portion of valve stem 20 lying outwardly beyond a first shoulder 23 formed on the valve stem, the shoulder having a greater diameter than the portion of the valve stem on which the first valve element 22 is slidably mounted. A second valve element 24 is slidably mounted on the portion of the valve stem lying between first shoulder 23 and a second shoulder 25 which is of a larger diameter than shoulder 23. The second valve element 24 has a centrally disposed recess 26 which serves as a seat for first valve element 22, and the second valve element 24 also has an annular surface 27 adapted to seat against the outermost peripheraledge of outlet valve chamber 17, the second valve element, when in the closed position, forming a seal between discharge passageway 16 and outlet valve chamber 17. The second valve element 24 is provided with a series of bleeder passages 28 extending between the centrally disposed recess 26 and the undersurface of the valve element where the passages communicate with outlet valve chamber 17. When the first valve element 22 is seated in recess 26, the bleeder passages 28 are closed to the flow of fluid therethrough.

A third valve element 29 is slidably mounted on the valve stem 20 within the confines of inlet valve chamber 13*a*, the valve stem having a third enlarged shoulder 30 lying on the opposite side of the third valve element 29. The third valve element 29 is biased in the direction of third shoulder 30 by means of collar 31 and spring 32 surrounding the valve stem 20, the spring extending between the collar 31 and the closed end of inlet valve chamber 13*a*. A fourth valve element 33, which is cup-shaped, is also contained within inlet valve chamber 13*a*, the fourth valve element being slidably mounted on the portion of the valve stem 20 lying between third shoulder 30 and a fourth enlarged shoulder 34. The cup-shaped fourth valve element has a centrally disposed recess 35 which forms a seat for third valve element 29 when the latter is in the closed position, and the fourth valve element also has an annular surface 36 adapted to seat against and close the peripheral edge of inlet valve chamber 13*a* at its juncture with delivery passageway 14*a*. Thus, when in the closed position shown in FIG. 2, the fourth valve element 33 prevents the flow of fluid from inlet chamber 13*a* into delivery passageway 14*a*. The fourth valve element 33 is also provided with a series of bleeder passages 37 extending between the centrally disposed recess 35 and the undersurface of the valve element which is in communication with delivery passageway 14*a*. As will be apparent from FIG. 2, when the third valve element 29 is in its closed position, the bleeder passages 37 are closed to the flow of fluid between inlet valve chamber 13*a* and delivery passageway 14*a*.

The arrangement of the valve elements is such that they will be sequentially opened as the valve stem 20 is displaced. Such sequential opening is controlled by the spacing of the shoulders 23, 25, 30 and 34 relative to the valve elements they are adapted to contact and displace. In a preferred embodiment, the first shoulder 23 will contact and commence opening movement of the first valve element 22 when the valve stem 20 has traveled approximately 10% of its intended displacement between its fully closed and fully open positions. In similar fashion, the second shoulder 25 will contact and commence opening movement of the second valve element 24 when the valve stem has traveled approximately 20% of its total displacement, with the third shoulder 30 contacting and commencing opening movment of the third valve element 29 at approximately 30% of valve stem displacement, and with the fourth shoulder 34 contacting and commencing opening movement of the fourth valve element 33 at approximately 40% of total valve stem displacement. While the valve elements open and close quite rapidly, their sequential movement is important to the operation of the system in order to maintain the system under positive fluid pressure at all times, the control valve elements coacting with the check valves in the delivery and outlet passageways in a manner which will be next described. In other words, the system forms a closed hydraulic loop which is completely filled with fluid at all times, although the pressure of the fluid will vary between the various passageways and chambers depending upon the positions of the control valves 3 and 4.

Assuming, as a place of beginning, that the control valves are in the positions illustrated in FIG. 1, in which the control valve 3 is in its fully opened postion and control valve 4 in its fully closed position. Under these conditions, the inlet passageway 12 has charged the valve chamber 13, delivery passageway 14, piston chamber 9, and discharge passageway 16 with fluid under high pressure, and the head 10 of piston 2 will have been displaced to its outermost position. When the control valve 3 is subsequently closed (which will normally occur prior to the opening of control valve 4), the delivery passageway 14 will be sealed by valve elements 29 and 33 and high pressure fluid will be trapped in delivery passageway 14, piston chamber 9, and discharge passageway 16.

In order to move the piston 2 in the opposite direction, it is necessary to open control valve 4 so that high pressure fluid may be introduced into the opposite side of the system through inlet passageway 12*a*. However, in order for the high pressure fluid to displace piston head 10*a* outwardly in chamber 9*a*, it is necessary to first relieve the high pressure fluid in chamber 9 which is effectively holding the piston head 10 in its outermost position. To this end, as the cam 6 comes into contact with valve stem 20 of control valve 4, movement of the valve stem will be initiated and in the first stage of operation the shoulder 23 will contact and lift the first valve 22, thereby opening bleeder passages 28 to initially relieve the high pressure fluid in discharge passageway 16. Since the area of valve element 22 is quite small in relation to the area of second valve element 24, the force required to open the first valve element 22 against the high pressure fluid in passageway 16 is relatively small as compared to the force which would be required to open the second valve element 24. As the high pressure fluid flows through the bleeder passages 28 the fluid pressure in passageway 16 will be relieved and the fluid pressure on opposite sides of the larger second valve element 24 will be equalized and the second valve element will be free to open as the second shoulder 25 of valve stem 20 contacts and lifts second valve element 24, thereby breaking the seal between the annular surface 27 of the second valve element and the seat forming circumferential edge of valve chamber 17. The opening of the larger second valve elements permits the rapid relief of the high pressure fluid trapped in the passageways 14 and 16 and in piston chamber 9.

As the trapped high pressure fluid is released, the increased pressure in outlet chamber 17 will open the check valve 19, thereby permitting fluid flow through outlet passageway 18 for return to the fluid supply tank, indicated diagrammatically at 38. It is to be understood that prior to the time the first valve element 22 is opened, the outlet valve chamber 17 also will be filled with fluid. To this end, the check valve 19 maintains valve chamber 17 filled with fluid at all times, although the fluid in valve chamber 17 will be at a much lower pressure, such as 20–80 psi, established by the holding force of check valve 19. Thus while the high pressure fluid ahead of valve elements 22 and 24 is relieved, both piston chamber 9 and discharge passageway 16 will remain completely filled with fluid, although under reduced pressure which will be equal to the holding force of check valve 19. In this connection, it will be noted that the check valve 15 in inlet passageway 14 is oriented to vent high pressure fluid from the delivery passageway 14 down to the holding force of check valve 15, which may be the same holding force of check valve 19, although it may be somewhat higher. Thus, at the end of the second stage of operation of control valve 4, the fluid pressure holding piston head 10 in its outermost position in piston chamber 9 will have been reduced to a nominal level which, as will become apparent hereinafter, is effectively equal to the reduced fluid pressure which is then bearing against the inner surface of the opposing piston head 10*a* so that the piston heads 10 and 10*a* are momentarily in an equilibrium condition.

As also will be evident from FIG. 1, even when the third and fourth valve elements 29 and 33 are in their closed positions, high pressure fluid from inlet passageway 12*a* is free to flow into inlet valve chamber 13*a* through branch passageway 39*a*, and consequently high pressure fluid lies to the inside of cup-shaped fourth valve element 33 and also surrounds third valve element 29. In the third stage of valve operation, continued movement of the valve stem 20 will cause third shoulder 30 to contact third valve element 29 and displace it from sealing contact with recess 35 in the fourth valve element, thereby opening the bleeder passageways 37 in the fourth valve element to the flow of high pressure fluid, the high pressure fluid entering delivery passageway 14*a*, thereby equalizing the pressure on the opposite sides of fourth valve element 33 so that the larger fourth valve element is free to open as the fourth enlarged shoulder 34 of the valve stem engages and lifts the fourth valve element.

Opening of fourth valve element 34 subjects delivery passageway 14*a* to the full force of the high pressure fluid, and the high pressure fluid impinges against and opens check valve 15*a* to permit the fluid to flow into the portion of piston chamber 9*a* lying inwardly of piston head 10*a*. With this arrangement, high pressure fluid is made substantially instantaneously available to displace the piston head 10*a* from its innermost to its outermost position. It will be remembered that control valve 3 will have been fully closed prior to the opening of control valve 4, and both the inner portion of chamber 9*a* and discharge passageway 16*a* are filled with fluid at nominal pressure, the high pressure fluid having been relieved when control valve 3 was opened, just as the high pressure fluid in piston chamber 9 and discharge passageway 16 was relieved upon the opening of control valve 4. Consequently, the full impact of the high pressure fluid introduced through inlet passageway 12*a* acts directly upon the inner surface of piston head 10*a*—which is the only part free to move—and the only fluid resistance to the movement of piston head 10*a* is the nominal fluid pressure previously established in the opposing piston chamber 9. Even upon inward displacement of piston head 10 as piston head 10*a* is forced outwardly, there will be no pressure build up in piston chamber 9 since it is effectively vented through discharge passageway 16 and the open first and second valve elements 22 and 24 of control valve 4; consequently the fluid pressure in piston chamber 9 will remain constant at the nominal pressure established by check valve 19 in outlet passageway 18. There will be no build up of pressure in delivery passageway 14 due to the check valve 15 which is oriented to prevent fluid flow in the direction of delivery passageway 14.

As cam 6 of control valve 4 continues its rotation, the valve stem 20 will be released for return to the closed position under the influence of springs 21 and 32. Thus, as the fourth shoulder 34 on valve stem 20 retracts, the cup-shaped fourth valve element 33 will be released for closing movement. However, even when the fourth valve element 33 is fully open, there is high pressure fluid on the upstream side of this valve element, because of the recess 33*a* which is in communication with branch passageway 39*a* when the valve element 33 is fully opened. Thus there is balancing high pressure fluid on both sides cup-shaped valve element 33 and it is free to slide axially on valve stem 20 when released by its supporting shoulder. However, positive closing force is not applied until the third shoulder 30 release the third valve element 29 for closing movement under the influence of spring 32, whereupon third valve element 29 will seat in recess 35 of the fourth valve element 33 and the spring 32 will thereupon urge both valve elements to their fully closed positions, the valve element thus closing and sealing the entrance to inlet passageway 14*a*. In similar fashion the second shoulder 25 will release the second valve element 24 for axial movement along the valve stem 20, followed by the release of first valve element 22 by its supporting shoulder 23, whereupon the spring 21 will urge first valve element 22 into contact with the recess 23 in the second valve element, and in turn, will urge both the first and second valve element 22 and 24 to their fully closed positions, it being remembered that the fluid pressure on opposite sides of valve elements 22 and 24 was equalized when they were opened.

When the control valve 4 is fully closed, high pressure fluid will continue to occupy inlet passageway 14*a*, piston chamber 9*a* and discharge passageway 16*a*, the latter passageway being closed at its discharge end by valve elements 22 and 24 of control valve 3. The outlet valve chamber 17*a* also will be filled with fluid, but the fluid will be at nominal pressure as established by check valve 19*a*.

As should now be evident, as the cam 5 starts the next cycle of operation by opening control valve 3, the high pressure fluid in piston chamber 9*a* and discharge passageway 16*a* will be relieved and the fluid pressure therein reduced to the nominal value established by check valve 19*a*, followed by the introduction of high pressure fluid into piston chamber 9 through delivery passageway 14, the high pressure charge displacing piston head 10 outwardly to effect a power stroke. Since the entire system is completely filled with fluid at all times, there is no draining and filling of the various passageways and chambers as in conventional systems and the operational time lag is insignificant. The only fluid flow is that which is required to displace the piston heads, and the magnitude of the pressure which can be exerted on the piston heads is limited only by the ability of the system to withstand the pressure which is exerted; and consequently tremendous moving forces can be developed.

Figure 4:
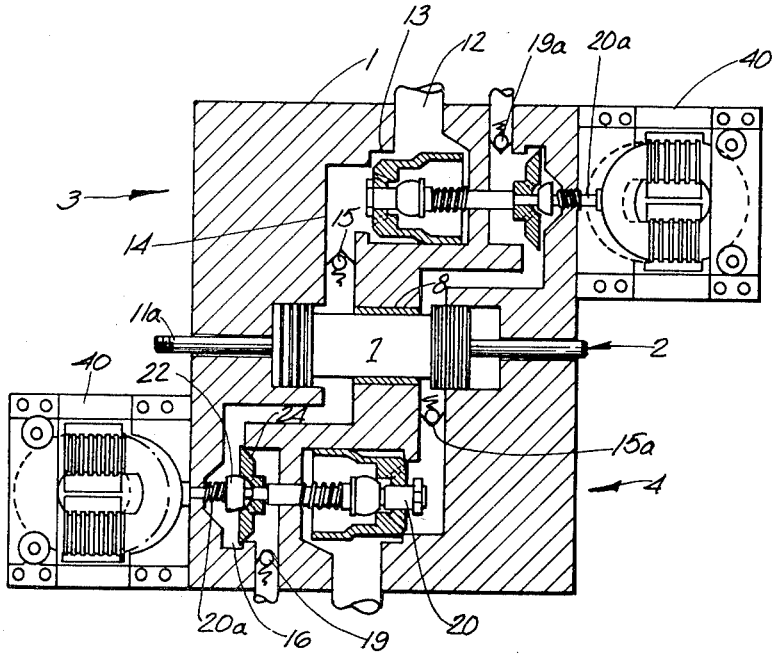
FIG. 4 is a sectional view similar to FIG. 1 illustrating the use of solenoids to move the control valves.

Modifications may be made in the invention without departing from its spirit and purpose. The embodiment which has been described utilizes actuating cams acting directly against the stems of the control valves; however, other actuating means may be employed to open and close the control valves 3 and 4. For example, as illustrated in FIG. 4, the control valves 3 and 4 may be actuated by servo mechanisms, such as the solenoids 40 which are operatively connected to the ends of the valve stems 20. In this embodiment, the solenoids are connected to the ends 20*a* of the valve stems which project beyond the first valve elements 22 although obviously the solenoids could be connected to the opposite ends of the valve stems, if so desired. Solenoids and similar servo-mechanisms permit remote operation of the control valves, as opposed to the direct control afforded by the cams 5 and 6 shown in the embodiment of FIG. 1.

Figure 5:
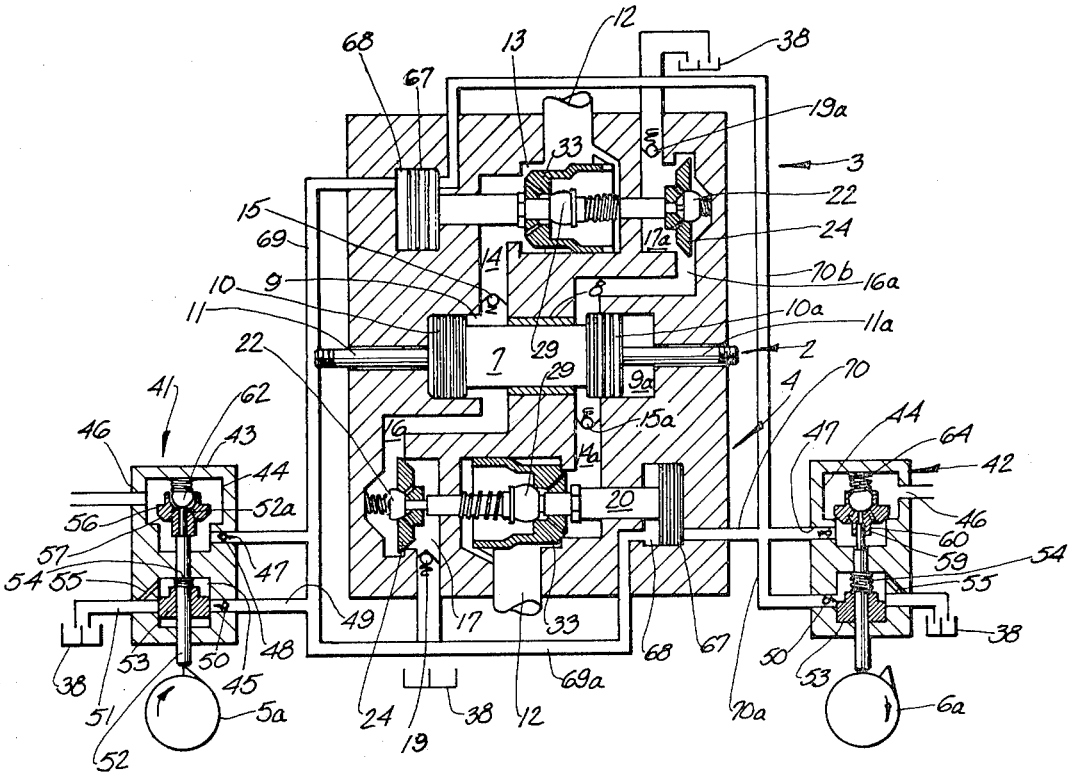
FIG. 5 is a sectional view similar to FIG. 1 illustrating a system utilizing hydraulic actuating valves for moving the control valves.
Figure 6:
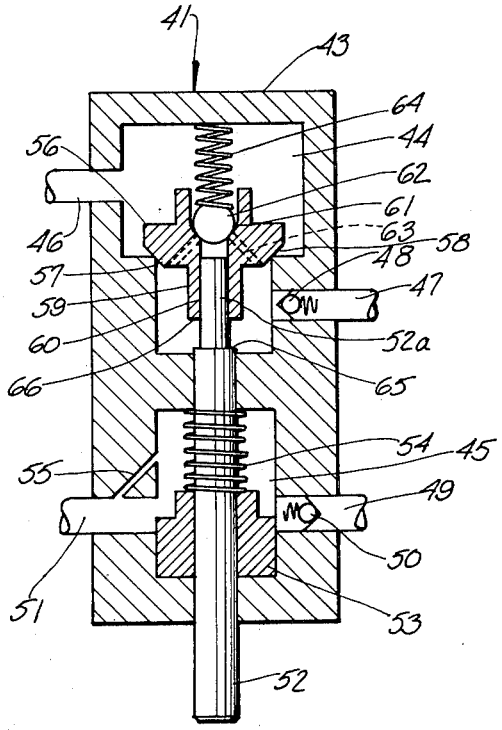
FIG. 6 is an enlarged fragmentary sectional view illustrating one of the actuating valve mechanism in its closed position.
Figure 7:
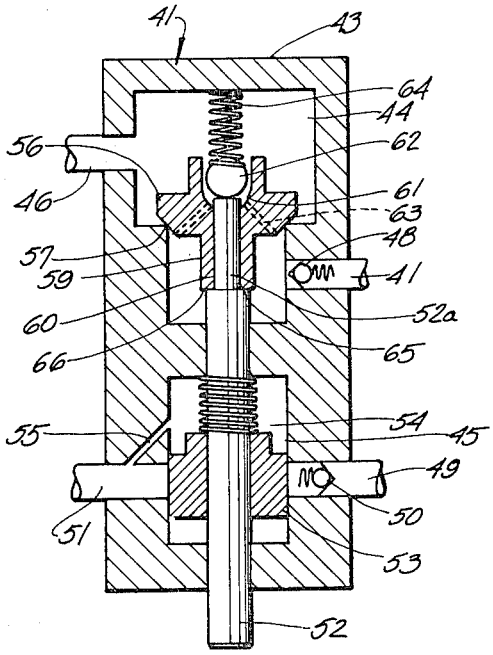
FIG. 7 is an enlarged fragmentary sectional view similar to FIG. 6 illustrating the actuating valve parts in the partially opened condition.

It has been found that additional advantages can be achieved by utilizing an hydraulically controlled actuating system for the control valves. A system of this character is illustrated in FIGS. 5, 6 and 7, wherein like parts of the system have been given like reference numerals. In this embodiment, the control valve 3 is operated by a remote actuating valve assembly, indicated generally at 41, whereas the control valve 4 is operated by remote actuating valve assembly 42. Since the remote actuating valves 41 and 42 are of identical construction, they will be given identical reference numerals, as was done in the case of control valves 3 and 4.

Each of the actuating valves comprises a housing 43 having a pressure chamber 44 and a pressure relief chamber 45. Pressure chamber 44 has an inlet port 46 adapted to be connected to a source of fluid under high pressure, which may be the same fluid source and at the same pressure as the high pressure fluid supplied to inlet passageways 12 and 12*a*. Each pressure chamber 44 also has a delivery port 47 which contain a check valve 48 oriented to permit fluid to flow outwardly from the pressure chamber but not return. The pressure relief chamber 45 has an inlet port 49 containing a check valve 50 oriented to permit fluid to flow into the chambers 45 but not return, together with an outlet port 51 for discharging fluid from the chamber to the common fluid supply tank, again indicated by the reference numeral 38.

Each actuating valve is provided with a push rod 52 extending between and axially movable relative to the chambers 44 and 45, the push rod projecting outwardly through the housings 43 for contact by one of the actuating cams 5*a* or 6*a* which, it will be understood, will be driven in timed relation in accordance with the desired operating sequence of the system. Within the pressure relief chambers 45 each push rod mounts a valve element 53 fixedly secured to the push rod for joint movement therewith, the valve elements being movable from a first position in which the ports 49 and 51 in relief chamber 45 are open to the flow of fluid to a second position in which the ports 49 and 51 are sealed at their junctures with relief chamber 45. A spring 54 surrounds the push rod 52 and is positioned to bias the push rod 52 and valve element 53 in the direction of the actuating cam controlling movement of the actuating valve. Relief chamber 45 is also provided with a bleeder passage 55 which interconnects the upper portion of the relief chamber with outlet port 51.

At its uppermost end the push rod 52 lies within chamber 44 where it slidably mounts a valve element 56 contained within the pressure chamber 44, the valve element having an annular surface 57 adapted, when the valve element is closed, to seat against the annular shoulder 58 in pressure chamber 44, the annular shoulder lying between inlet port 46 and outlet port 47. As best seen in FIGS. 6 and 7, the valve element 56 has a depending body portion 59 with a centrally disposed axial bore 60 opening upwardly into an annular recess 61 which defines a seat for ball valve element 62 which, when in the fully seated position, closes the upper end of axial bore 60 as well as bleeder passages 63 which extend between the annular recess 61 and the underside of the valve element 56. A spring 64 normally biases the ball valve element 62 to its fully seated position. The push rod 52 has a reduced diameter upper end 52*a* of a size to be slidably received within axial bore 60, the push rod also having a shoulder 65 of a size to contact the under surface 66 of body portion 59 when the push rod is elevated. Thus, as seen in FIG. 7, as the push rod 52 is elevated by its actuating cam, the reduced diameter upper portion will contact and unseat ball valve element 62 against the compression of spring 64, thereby opening bleeder passages 63. Continued upward movement of the push rod will cause shoulder 65 to seat against the undersurface 66 of body portion 59, thereby lifting the entire valve element 56 and removing annular surface 57 from contact with seat 58. At the same time, valve element 54 in relief chamber 45 will be closing ports 49 and 51.

Referring again to FIG. 5, the control valves 3 and 4 are each provided with a piston 67 connected to the base end of the valve stems 20, the pistons being slidably received in piston chambers 68 formed in housing 1. Actuating valve 41 controls the opening movement of control valve 3 through a conduit 69 connected at one end to the outer end of piston chamber 68 of control valve 3, the conduit 69 being connected at its opposite end to both delivery port 47 and relief inlet port 49 of actuating valve 41, the conduit 69 also being in communication with a branch conduit 69*a* connected to the inner end of piston chamber 68 of control valve 4. In similar fashion, actuating valve 42 controls the opening movement of control valve 4 through a conduit 70 connected to the outer end of piston chamber 68 of control valve 4, the conduit 70 being connected at its opposite end to delivery port 47 of actuating valve 42 and also to relief inlet port 49 through a branch conduit 70*a*. The actuating valve 42 is also connected to the inner side of piston chamber 68 of control valve 3 through a branch conduit 70*b*.

In the operation of the actuating valves, when the valve 41 is in the fully open position shown in FIG. 5, high pressure fluid introduced into pressure chamber 44 through inlet port 46 will flow around the open valve element 56 and will be discharged into delivery port 47, the high pressure fluid opening the check valve 48 which also has a nominal holding force of from 20–40 psi. The high pressure fluid thus flows through conduit 69 and opens control valve 3 by displacing piston 67 inwardly within piston chamber 68. At the same time, high pressure fluid flows through conduit extension 69*a* and exerts pressure against the inner surface of piston 67 of control valve 4 (which is closed), thereby applying a high pressure holding force to maintain the control valve 4 in its fully closed position. While the high pressure fluid also impinges against and opens check valve 50 in inlet port 49 leading to pressure relief chamber 45, fluid flow into the relief chamber is blocked by valve element 53 which, in the elevated position of push rod 52, closes both inlet port 49 and outlet port 51.

When cam 5*a* controlling actuating valve 41 releases its push rod 52 for closing movement, the annular surfaces 57 of valve element 56 will first seat against annular shoulder 58 in chamber 44, followed by the release of ball valve element 62 by the distal end of the reduced diameter upper end 52*a* of the push rod. As valve elements 56 and 62 close, valve element 53 in pressure relief chamber 45 will open, thereby relieving the high pressure by permitting the high pressure fluid in conduit 69 to flow through relief chamber 45 and return to the fluid supply tank 38 through outlet port 51. Check valve 48 in conduit 47 is oriented to vent the discharge side of chamber 44 but will maintain fluid in the discharge side of chamber 44 at the holding force of check valve 48. Check valve 50 in inlet port 49, which also has a holding force of from 20–40 psi and was opened by the high pressure fluid, will reclose when the fluid pressure in conduit 69 is reduced to the holding force of the check valve. Consequently conduit 69 and extension 69*a* will remain completely filled with fluid, as will the sides of piston chambers 68 to which the conduits are connected, although the fluid will be at the nominal pressure.

As the fluid in piston chamber 68 of control valve 3 is reduced to nominal value, the control valve 3 will close under the influence of springs 21 and 32 which urge the valve elements to their closed positions, it being remembered that the fluid pressure on the opposite sides of the valve elements will have been equalized upon their opening movement and consequently the closing movement of the control valve is effectively resisted only by the nominal fluid pressure in piston chamber 68 of control valve 3. However, this nominal pressure will be offset by the nominal pressure maintained on the opposite side of the valve stem piston through branch conduit 70*b* connected to actuating valve 42 which, when closed, maintains the conduits 70, 70*a* and 70*b* filled with fluid under pressure in the same manner that actuating valve 41 maintains fluid in conduits 69 and 69*a*.

As the actuating valve 42 is opened, the ball valve element 62 will be lifted, thereby permitting high pressure fluid on the upstream side of the valve element 56 to flow through bleeder passages 63 to equalize fluid pressure on opposite sides of valve element 56, thereby freeing the valve element 56 for opening movement upon contact of shoulder 65 with the undersurface 66 of depending body portion 59, whereupon high pressure fluid will flow through conduit 70 to displace piston 67 of control valve 4, thereby opening control valve 4. At the same time, extension conduit 70*b* will be subjected to high pressure fluid, and piston 67 of control valve 3 will be held tightly closed. To the extent that the opening movement of piston 67 in control valve 4 displaces fluid in the piston chamber 68 on the opposite sides of the piston 67, which is under nominal pressure, such fluid will be discharged through conduit 69*a* and relief chamber 45 of actuating valve 41. While excess pressure is thus relieved, conduits 69 and 69*a* will nonetheless remain filled with fluid at the nominal pressure established by check valve 50, and the system remains fully charged. It is not necessary, however, to maintain charges of fluid under pressure in the pressure relief chambers 45 of actuating valves 41 and 42; and to this end, any residual fluid remaining in the chambers 45 will be relieved through bleeder passages 55 as the valve elements 53 are displaced to close ports 49 and 51.

When control valve 42 recloses upon release of its push rod 52 by cam 6*a*, the high pressure fluid in conduits 70, 70*a* and 70*b* will be relieved by check valve 50 and the open pressure relief chamber 45, but the conduits and the ends of the valve stem piston chambers to which they are connected will remain filled with fluid at the nominal pressure established by check valve 50. Accordingly, control valve 4 will be released to close under the influence of its valve springs 21 and 32, the counterbalancing nominal pressures on the opposite sides of the valve stem piston permitting the springs to close all of the valve elements on control valve 4.

As should now be apparent, the actuating valves also function as a closed loop system which is filled with fluid at all times, thereby providing substantially instantaneous response when the actuating valves are activated by their cams.

While various modifications of the invention have been set forth, others will undoubtedly occur to the worker in the art upon reading this specification, and it is not intended that the scope of the invention be limited other than in the manner set forth in the claims which follow.

What is claimed is:

1. A method of operating a fluid power system having a piston with opposing piston heads reciprocally mounted in opposing piston chambers, said piston being adapted to be driven from one end of its stroke to the other by fluid pressure, which comprises the steps of establishing a condition in which the piston is at one end of its stroke and each of said piston heads is under positive fluid pressure, a first of the piston heads being under relatively high pressure oriented to maintain the piston at the end of its stroke and the other of said piston heads being under relatively nominal pressure oriented in opposition to the high pressure exerted on the first piston head, and driving the piston to the opposite end of its stroke by first relieving the high pressure on the first of said piston heads to a nominal level and thereafter rapidly increasing the fluid pressure on the other of said piston heads, including the step of maintaining said piston heads under positive fluid pressure at all times by establishing a closed loop hydraulic system having a first side in communication with the piston chamber for said first piston head and a second side in communication with the piston chamber for the other of said piston heads, including the step of maintaining said system filled with fluid at all times.

2. The method claimed in claim 1 wherein the high pressure on said first piston head is relieved to the same nominal fluid pressure exerted on the other of said piston heads, whereby said piston is in an equilibrium state prior to increasing the fluid pressure on the other of said piston heads.

3. The method claimed in claim 2 including the step of maintaining the reduced nominal pressure on the first of said piston heads at essentially the same nominal level as the piston is driven to the opposite end of its stroke.

4. The method claimed in claim 1 including the step of relieving the high pressure on the first piston head by discharging a portion of the fluid from the first side of the system.

5. The method claimed in claim 4 including the step of rapidly increasing the fluid pressure on the other of said piston heads by introducing fluid under high pressure into the second side of the system while holding the fluid already in the second side of the system against displacement.

6. The method claimed in claim 5 including the step of maintaining one side of the system under high pressure at all times the piston is at rest, whereby the piston is positively held against displacement while at rest.

7. The method claimed in claim 6 including the step of causing the fluid to contact one side only of each of said piston heads, and maintaining the opposite side of the piston heads free from contact by the said fluid.

* * * * *